US005345019A

United States Patent [19]

Bigeard et al.

[11] Patent Number: 5,345,019

[45] Date of Patent: Sep. 6, 1994

[54] METHOD OF HYDROCRACKING PARAFFINS EMANATING FROM THE FISCHER-TROPSCH PROCESS USING CATALYSTS BASED ON H-Y ZEOLITE

[75] Inventors: Pierre-Henri Bigeard, Vienne; Alain Billon, Le Vesinet; Pierre Dufresne, Valence; Samuel Mignard, Chatou, all of France

[73] Assignee: Institut Francais Du Petrole, Rueil Malmaison, France

[21] Appl. No.: 886,225

[22] Filed: May 21, 1992

[30] Foreign Application Priority Data

May 21, 1991 [FR] France ..... 91 06141

[51] Int. Cl.[5] ..... C07C 5/00; C07C 5/42

[52] U.S. Cl. ..... 585/264; 585/265; 585/733; 585/946

[58] Field of Search ..... 585/264, 265, 733, 946

[56] References Cited

U.S. PATENT DOCUMENTS

| | | | |
|---|---|---|---|
| 3,147,210 | 9/1954 | Hass et al. | 208/210 |
| 3,647,678 | 3/1972 | Egan et al. . | |
| 3,974,061 | 8/1976 | Quisenberry | 208/65 |
| 4,041,097 | 8/1977 | Ireland et al. | 585/733 |
| 4,046,831 | 9/1977 | Kuo | 585/733 |
| 4,080,397 | 3/1978 | Derr et al. | 585/733 |
| 4,252,736 | 2/1981 | Haag et al. | 585/733 |
| 4,471,145 | 9/1984 | Chu et al. | 585/733 |
| 4,544,792 | 10/1985 | Smith et al. | 585/733 |
| 4,645,585 | 2/1987 | White | 208/58 |
| 4,684,756 | 8/1987 | Derr, Jr. et al. | 585/330 |
| 4,738,940 | 4/1988 | Dufresne et al. . | |
| 4,832,819 | 5/1989 | Hamner | 208/27 |
| 4,919,786 | 4/1990 | Hamner et al. | 585/749 |
| 4,943,672 | 7/1990 | Hamner et al. | 585/733 |

FOREIGN PATENT DOCUMENTS 310165 4/1989 European Pat. Off. .

*Primary Examiner*—Anthony McFarlane
*Assistant Examiner*—E. D. Irzinski
*Attorney, Agent, or Firm*—Millen, White, Zelano, & Branigan

[57] ABSTRACT

A method of hydrocracking charges emanating from the Fischer-Tropsch process, in which:

(a) hydrogen is reacted with the charge in contact with a catalyst 1 in a first reaction zone, the said catalyst 1 comprising at least one alumina-based matrix and at least one hydro-dehydrogenation component;

(b) the effluent from the first reaction zone is put into contact with a catalyst 2 in a second reaction zone, the said catalyst 2 comprising:

20 to 97% by weight of at least one matrix;

3 to 80% by weight of at least one Y zeolite in hydrogen form, the said zeolite being characterized by an $SiO_2/Al_2O_3$ molar ratio of over 4.5:1, a sodium content of less than 1% by weight determined on a zeolite calcined at 1100° C.; an $a_o$ crystal parameter of the elemental mesh of less than $24.70\times10^{-10}$ m; and a specific surface area determined by the BET method of over 400 $m^2.g^{-1}$;

and at least one hydro-dehydrogenation component.

18 Claims, No Drawings

METHOD OF HYDROCRACKING PARAFFINS EMANATING FROM THE FISCHER-TROPSCH PROCESS USING CATALYSTS BASED ON H-Y ZEOLITE

BACKGROUND OF THE INVENTION

The invention concerns a method of converting paraffins emanating from the Fischer-Tropsch process. It particularly uses bifunctional zeolitic catalysts for hydrocracking paraffins coming from a Fischer-Tropsch process, enabling highly upgraded products to be obtained, such as kerosene, gas oil and especially basic oils.

SUMMARY OF THE INVENTION

The invention concerns a method of converting paraffins emanating from the Fischer-Tropsch process, using a bifunctional catalyst containing a faujasite-type zeolite which may be specially modified, dispersed in a matrix generally based on alumina, silica, silica-alumina, alumina-boron oxide, magnesia, silica-magnesia, zirconia, or titanium oxide, or based on a combination of at least two of the preceding oxides, or based on a clay or a combination of the preceding oxides with clay. The function of the matrix is chiefly to help to shape the zeolite, in other words to produce it in the form of agglomerates, balls, extrudates, pellets, etc., which can be put in industrial reactor. The proportion of matrix in the catalyst is from 20 to 97% by weight and preferably from 50 to 97% by weight.

In the Fischer-Tropsch process, the synthesis gas ($CO+H_2$) is converted catalytically to oxygenated products and essentially linear hydrocarbons in gaseous, liquid or solid form. These products are generally free from heteroatomic impurities such as sulfur, nitrogen or metals. The products cannot, however, be used as they are, chiefly because their cold-withstanding properties are incompatible with the normal uses of petroleum cuts. For example, the pour point of a linear hydrocarbon containing 20 carbon atoms per molecule (boiling point equal to about 344° C., i.e. included in the gas-oil cut) is about +37° C., whereas Customs specifications require a pour point below −7° C. for commercial gas-oils. These hydrocarbons from the Fischer-Tropsch process then have to be converted to upgraded products such as kerosene and gas-oil after undergoing catalytic hydrocracking reactions.

Catalysts that are currently used in hydrocracking are all of the bifunctional type, combining an acid and a hydrogenating function. The acid function is provided by carriers of a large surface area (generally 150 to 600 $m^2.g^{-1}$) which have surface acidity, such as halogenated (especially chlorinated or fluorinated) aluminas, combinations of oxides of boron and aluminium, amorphous silica-aluminas and zeolites. The hydrogenating function is provided either by one or more metals from Group VIII of the Periodic Table, such as iron, cobalt, nickel, ruthenium, rhodium, palladium, osmium, iridium and platinum, or by a combination of at least one metal of Group VI with at least one Group rill metal.

Equilibrium between the two Functions, acid and hydrogenating, is the fundamental parameter governing the activity and selectivity of the catalyst. A weak acid function and a strong hydrogenating function give catalysts that are less active and selective to isomerisation, whereas a strong acid function and a weak hydrogenating function give catalysts that are very active and selective to cracking. It is thus possible to adjust the dual activity/selectivity property of the catalyst by choosing each of the functions carefully.

Acid carriers, in increasing order of acidity, include aluminas, halogenareal aluminas, amorphous silica-aluminas and zeolites.

Patent EP-B-O 147 873 describes a catalyst comprising a Group VIII element on a support during a process involving the Fischer-Tropsch synthesis followed by hydrocracking.

Patent Application EP-A 0 356 560 describes the preparation of a very specific Y zeolite that can be used in a Fischer-Tropsch catalyst or in a hydrocracking catalyst.

The catalyst of the invention contains a Y zeolite of faujasite structure (Zeolite Molecular Sieves Structure, Chemistry and Use, D. W. Breck, J. Wiley and Sons, 1973). Of the zeolites that may be used it is preferable to use stabilized Y zeolite, currently described as ultrastable of USY, either in a form partially exchanged with cations of rare earths with an atomic number from 57 to 71 inclusive, so that its rare earth content, expressed in percent by weight of rare earth oxides, is less than 10% and preferably less than 6%, of in hydrogen form.

The important research work on many zeolites carried out by the Applicants has led to the surprising discovery that use of a catalyst comprising a Y zeolite makes it possible to convert charges emanating from the Fischer-Tropsch process to highly upgraded products.

The zeolite used in the catalyst of the invention is preferably an HY acid zeolite characterize by various specifications: an $SiO_2$:$Al_2O_3$ molar ratio over 4.5:1 and preferably from 8: 1 to 70: 1; a sodium content less than 1% by weight and preferably less than 0.5% by weight, determined on zeolite calcined at 1100° C.; an $a_o$ crystal parameter of the elemental mesh less than $24.70\times10^{-10}$ meter and preferably from 24.2433 $10^{-10}$ to $24.55\times10^{-10}$ meter; and a specific surface area determined by the BET method of over 400 $m^2/g$ and preferably over 550 $m^2/g$.

The various properties are measured by the methods specified below:

The $SiO_2$:$Al_2O_3$ molar ratio is measured by X-radiation. When the quantities of aluminum become small, e.g. less than 2%, it is opportune to use a method of determination by atomic adsorption spectrometry. For greater precision.

The mesh parameter is calculated from the X-ray fluorescence diagram, by the method described in ASTM D3 942-80.

The specific surface area is determined by measuring the nitrogen adsorption isotherm at the temperature of liquid nitrogen, and calculated by the classic BET method. The samples are pretreated, before being measured, at 500° C. with dry nitrogen scavenging.

This zeolite is known from prior art (French Patent 2 561 946). The NaY zeolite which generally provides the raw material contains over 5% by weight of sodium and has an $SiO_2$:$Al_2O_3$ molar ratio from 4:1 to 6:1. It is not used as such, and has to undergo a series of stabilization treatments designed to increase its acidity and heat resistance.

It may be stabilized by various methods.

Y zeolite stabilization is most commonly carried out either by introducing cations of rare earths or cations of Group IIA metals or by hydrothermal treatment. All these treatments are described in French Patent FR 2 561 946.

There are however other stabilizing methods which are known From prior art. The extraction of aluminium by chelating agents such as ethylene diamine terracetic acid or acetyl acetone should be mentioned, It is also possible to proceed to partial substitutions of aluminum atoms in the crystal lattice by atoms of exogenous silicon. This is the principle underlying the high-temperature treatment with silicon tetrachloride described in the Following reference: H. R. BEYER et al., Catalysis by Zeolites, ed. B. Imelik et al., Elsevier, Amsterdam—1980—p 203. It is also the principle underlying treatments carried out in liquid phase with Fluorosilicic acid, or salts of that acid, by a method described in the Following patents: U.S. Pat. Nos. 3,594,331, 3,933,983 and EP-B-0 002 211.

After all these stabilization treatments, exchanges can be effected with cations of Group IIA metals, cations of rare earths or cations of chromium and zinc, or with any other element which can improve the catalyst.

The HY or $NH_4Y$ zeolite thus obtained or any other HY or $NH_4Y$ zeolite with these characteristics may be incorporated in the previously described matrix in alumina gel state at this stage. The resultant catalyst comprises 20 to 97% by weight of matrix, 3 to 80% by weight of zeolite and at least one hydroadehydrogenation component. One of the methods of incorporating zeolite in the matrix which are preferred in the invention comprises kneading the zeolite and gel together, then passing the paste thus obtained through a die to form extrusions from 0.4 to 4 milimeters in diameter.

The hydro-dehydrogenation component of the catalyst according to the invention may e.g. be at least one compound (e.g. an oxide) of a metal From Group VIII of the Periodic Table (especially nickel, palladium or platinum), or a combination of at least one compound of a metal selected From the group formed by Group VI (especially molybdenum or tungsten) and at least one compound of a metal From Group VIII of the Periodic Table (especially cobalt or nickel).

In particular this invention comprises:

a method of hydrocracking charges emanating from the Fischer-Tropsch process, in which:

(a) hydrogen is reacted with the charge in contact with a catalyst 1 in a first reaction zone, the catalyst 1 comprising at least one alumina-based matrix and at least one hydrodehydrogenation component;

(b) the effluent from the first reaction zone is put into contact with a catalyst 2 in a second reaction zone, the catalyst 2 comprising:

20 to 97% by weight of at least one matrix;

3 to 80% by weight of at least one Y zeolite in hydrogen form, the said zeolite being characterized by an $SiO_2$:$Al_2O_3$ molar ratio of over 4.5:1, a sodium content of less than 1% by weight determined on a zeolite calcined at 1100° C.; an $a_o$ crystal parameter of the elemental mesh of less than $24.70\times10^{-10}$ m; and a specific surface area determined by the BET method of over 400 $m^2.g^{-1}$;

and at least one hydro-dehydrogenation component.

The concentrations of metal compounds, expressed as the weight of metal relative to the Finished catalyst, are as follows: from 0.01 to 5% by weight of Group VIII metals and preferably from 0.03 to 3% by weight in cases where they are exclusively noble metals of the palladium or platinum type; from 0.01 to 15% by weight of Group VIII metals and preferably from 0.05 to 10% by weight in cases where they are non-noble Group VIII metals, e.g. of the nickel type; when at least one metal or metal compound From Group VIII and at least one metal or metal compound From Group VI are used at the same time, about 5 to 40% and preferably 12 to 30% by weight of a combination of at least one compound (particularly an oxide) of a Group VI metal (particularly molybdenum or tungsten) and at least one Group VIII metal or metal compound (particularly cobalt or nickel) is used, with a weight ratio (expressed in metal oxides) of Group VIII to Group VI metals from 0.05:1 to 0.8:1 and preferably From 0.13:1 to 0.5:1.

The catalysts may advantageously contain phosphorus: indeed this compound is known from the prior art to bring two advantages to hydrotreatment catalysts: ease of preparation, particularly when impregnating with nickel and molybdenum solutions, and improved hydrogenating activity. The phosphorus content, expressed as the concentration of phosphorus oxide $P_2O_5$, will be below 15% by weight and preferably below 10% by weight.

The hydrogenating function as defined above may be incorporated in the catalyst at various levels of preparation and in various ways, as described in French Patent FR 2 561 946.

Catalysts based on $NH_4Y$ or HY zeolite as described above are, if necessary, subjected to a final calcination stage to obtain a catalyst based on Y zeolite in hydrogen form. The catalysts thus finally obtained are used to hydrocrack charges emanating from the Fischer-Tropsch process under the following conditions: hydrogen is reacted with the charge in contact with a catalyst 1 contained in reactor R1 (or a first reaction zone R1 ) , the Function of which is to remove the unsaturated and oxygenated hydrocarbon molecules produced in Fischer-Tropsch synthesis. The effluent from the reactor R1 is put into contact with a second catalyst 2 contained in reactor (or a second reaction zone R2) , the function of which is to provide the hydrocracking reactions. The effluent from the reactor 2 is fractionated into various conventional petroleum cuts such as gas, light oils, heavy oils, kerosene, gas-oil and ∓residue"; the fraction described as "residue" represents the heaviest fraction obtained in fractionation. The choice of temperature during the stage of fractionating effluent from the reactor 2 may vary very greatly, according to the specific needs of the refiner. Adjustment of the reaction temperature enables varying yields to be obtained from each cut.

Various modifications can be made. It is possible to recycle to reactor 1 or preferably to reactor 2 at least one these fractions; if a single reactor containing the catalysts is used, i.e. if a single reactor contains the two reaction zones, it is possible to recycle to the entrance of the reactor. Finally, it is possible to use only reactor 2 if the content of unsaturated products in the charge does not involve very substantial deactivation of the catalytic system. The fraction called "residue" can also be subjected to deparaffining operations after recovering the base oil.

The use of such a process has several features:

The main aim is the hydrocracking conversion of the charge, i.e. the transformation off the charge into lighter products. This hydrocracking conversion is often from 20 to 100% by weight, preferably 25 to 98% by weight.

The partial pressure of hydrogen is from 9 to 200 bars and preferably from 30 to 200 bars.

Operating conditions in the zone R2 are an hourly speed per volume (VVH) From 0.2 to 10 and preferably from 0.3 to 2 $m^3$ of charge/$m^3$ of catalyst/hour and a reaction temperature From 150° to 450° C. and preferably from 290° to 420° C. Operating conditions applied to the zone R1 may vary greatly according to the charge, the purpose being to reduce concentrations of unsaturated and/or heteratomic compounds to suitable levels. Under these operating conditions the cycle of the catalytic system lasts at least a year and preferably 2 years, and deactivation of the catalyst, i.e. the temperature increase which the catalytic system must undergo to obtain constant conversion, is less than 5° C./month and preferably less than 2.5°/month.

Distillates and base oils obtained by the method of the invention have very good features owing to their very paraffinic nature. For example, it is possible to obtain a kerosene cut of distillation interval between 150° and 250° C. having a vapor point greater than 50 mm, a gas-oil cut of distillation interval from 250° to 380° C. of cetane index equal to or greater than 65; the viscosity index of the oil obtained, after deparaffining with MEK/toluene solvent of the 380+ cut, is equal to or greater the 135 and the pour point is no higher than −12° C. The oil yield with respect to the residue depends on the total conversion of the charge. In the case of a zeolite catalyst, this yield is in the neighborhood of 5 to 70%, preferably 10 to 60% by weight.

The catalyst 1 at the first stage comprises a matrix based on alumina and preferably not containing any zeolite, and at least one metal with a hydro-dehydrogenating function. The said matrix may also contain silica-alumina, boron oxide, magnesia, zirconia, titanium oxide, clay or a combination of these oxides. The hydro-dehydrogenating function is provided by at least one metal or metal compound from Group VIII, particularly such as nickel and cobalt. A combination of at least one metal or metal compound from Group VI of the Periodic Table (particularly molybdenum or tungsten) and at least one metal or metal compound From Group VIII (particularly cobalt and nickel) may be used. The total concentration of metals of Groups VI and VIII, expressed in metal oxides, is from 5 to 40% by weight, preferably 7 to 30% by weight, and the weight ratio (expressed in metallic oxide(s)) morales) of Group VI to metal(s) of Group VIII is iron 1.25:1 to 20:1 and preferably 2:1 to 10:1. in addition, the catalyst can contain phosphorus. The content of phosphorus, expressed in concentration of $P_2O_5$ phosphorus oxide, will be less than 15% by weight, preferably less than 10% by weight.

The catalyst contained in the reactor R2 is that described in the main part of the text. It particularly comprises at least one HY zeolite characterized by an $SiO_2$/$Al_2O_3$ molar ratio of over 4.5:1 and preferably from 8:1 to 70:1; a sodium content less than 1% by weight and preferably less than 0.5% by weight determined on zeolite calcined at 1100° C.; an $a_o$crystal parameter of the elemental mesh less than $24.70\times10^{-10}$ meter and preferably from $24.24\times10^{-10}$ meter to $24.55\times10^{-10}$ meter; and a specific surface area determined by the BET method of over 400 $m^2.g^{-1}$ and preferably over 550 $m^2.g^{-1}$.

The examples given below illustrate the Features of the invention but without limiting its scope.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

In the foregoing and in the following examples, all temperatures are set forth uncorrected in degrees Celsius and unless otherwise indicated, all parts and percentages are by weight.

The entire disclosure of all applications, patents and publications, cited above and below, and of corresponding French application No. E.N. 91/06,141, are hereby incorporated by reference.

EXAMPLES

Example 1

Preparation of Catalyst A (not according to the invention)

The alumina gel used is provided by Condea under the reference SB3. After kneading, the paste obtained is extruded through a die 1.4 mm in diameter. The extrudates are calcined, then impregnated with a solution of a mixture of ammonium heptamolybdate, nickel nitrate, and orthophosphoric acid, and then calcined in air at 550° C. The weight contents, expressed as active oxides, are as follows with respect to the catalyst:

phosphorus oxide $P_2O_5$—2.5% by weight
molybdenum oxide $MoO_3$—15% by weight
nickel oxide NiO—5% by weight.

Example 2

An HY zeolite of Formula H $AlO_2(SiO_2)_{3.3}$ provided by Conteka under the reference CBV500 is used. This zeolite, of which the characteristics are:

$SiO_2$:$Al_2O_3$ molar ratio—6.6:1
crystalline parameter—$24.55\times10^{-10}$ meter
specific surface—690 $m^2/g$ is kneaded with SB3-type alumina provided by Condea. The kneaded paste is then extruded through a die of diameter 1.4 mm. The extrudates are next calcined and then impregnated in the dry with a solution of a mixture of ammonium heptamolybdate, nickel nitrate and orthophosphoric acid, and finally calcined in air at 550° C. The weight contents, expressed as active oxides, are the following with respect to the catalyst:

phosphorus oxide $P_2O_5$—2.5% by weight
molybdenum oxide $MoO_3$—15% by weight nickel
nickel oxide NiO—5% by weight,

Example 3

Preparation of catalyst C (in accordance with the invention)

An NaY zeolite is submitted to two exchanges in solutions of ammonium chloride so that the sodium content is 2.6% by weight. The product is then introduced into a cold oven and calcined in air at 400 C. At this temperature, an amount of water corresponding, after vaporization, to a partial pressure 50.7 kPa, is introduced into the calcining atmosphere. The temperature is then brought to 565° C. over two hours. The product is then submitted to exchange with a solution of ammonium chloride, followed by a very careful acid treatment under the following conditions: volume of 0.4N hydrochloric acid based on weight of solid of 10, duration 3 hours. The proportion of sodium then falls to 0.6% by weight and the $SiO_2$:$Al_2O_3$ ratio is 7.2:1. This product is then submitted to violent calcination in a static atmosphere at 780° C. for 3 hours, then again taken up in acidic solution with 2N hydrochloric acid, and a volume of solution based on weight of zeolite of 10. The crystal parameter is 24.28×10−10 meter, the specific surface area 825 $m^2/g$, the water absorption capacity 11.7 and the sodium ion absorption capacity 1.0, expressed as weight of sodium per 100 g of dealuminated zeolite.

The resultant zeolite is kneaded with type SB3 alumina supplied by Condea. The kneaded paste is extruded through a die 1.4 mm in diameter. The extrudates are calcined then impregnated dry with a solution of a mixture of ammonium heptamolybdate, nickel nitrate, and orthophosphoric acid, and then calcined in air at 550° C. The weight contents, expressed as active oxides, are as follows with respect for the catalyst:

phosphorus oxide $P_2O_5$—2.5% by weight
molybdenum oxide $MoO_3$—15% by weight
nickel oxide NiO—5% by weight.

Example 4

Preparation of catalyst D (not in accordance with the invention)

A laboratory-prepared silica-alumina is used, containing 25% by weight of $SiO_2$ and 75% by weight of $Al_2O_3$. 3% by weight of 67% pure nitric acid relative to the dry weight of silica-alumina powder is added to obtain peptisation of the powder. After being kneaded, the dough obtained is extruded through a die 1.4 mm in diameter. The extrudates are calcined, them impregulated dry with a solution off a salt of platinum tetramine chloride $Pt(NH_3)_4Cl_2$, and finally calcined in air at 550° C. The platinum content of the final catalyst is 0.6% by weight.

Example 5

Assessment of catalysts A, B, C and D in a hydrocracking test without recycling of the "residue" fraction Catalysts prepared as described in the preceding examples are used under hydrocracking conditions on a charge of paraffins emanating from Fischer-Tropsch synthesis, the chief characteristics of which are as follows:

| | |
|---|---|
| initial point | 114° C. |
| 10% point | 285° C. |
| 50% point | 473° C. |
| 90% point | 534° C. |
| final point | 602° C. |
| pour point | +67° C. |
| density (20/4) | 0.825 |

The catalytic test unit comprises one fixed-bed reactor with an upflow, in which 80 ml of catalyst is placed. The catalysts A, B and C are sulphurized by a mixture of n-hexane/DMDS with aniline at 320° C. The catalyst D is subjected to reduction by hydrogen in situ in the reactor. The total pressure is 5 MPa, the flow rate of hydrogen is 1000 liters of hydrogen gas per liter of charge injected, and the hourly speed by volume is 0.5.

The catalytic performances are expressed by the temperature that enables a net conversion level of 50% and by rough selectivity to be obtained. These catalytic performances are measured on the catalyst after a period of stabilization, usually at least 48 hours, has been carried out.

The net conversion NC is equal to:

$$NC = \frac{(\text{weight \% of } 380^+ \text{ effluents}) - (\text{weight \% of } 380^- \text{ charge})}{100 - (\text{weight \% } 380^- \text{ charge})} \times 100$$

The rough selectivity SB is equal to:

$$SB = \frac{(\text{weight of } 150/380 \text{ effluents})}{(\text{weight of } 380^- \text{ effluents})} \times 100$$

| Number of Example | Zeolite Content (Weight %) | Crystalline Parameter (× $10^{-10}$ meter) | T (°C.) (50% NC) | SB (50% NC) |
|---|---|---|---|---|
| 1 | 0 | / | 446 | 92.2 |
| 2 | 20 | 24.55 | 341 | 61.5 |
| 3 | 20 | 24.28 | 350 | 71.4 |
| 4 | 0 | / | 423 | 91.5 |

In the case of Example 3, there is obtained be deparaffining a 32% yield of oil with respect to the residue, the said oil having a viscosity index of 152.

The use of such a zeolite permits of the reduction of the temperature of net conversion NC by a substantial amount. A gain of about 100° C. is observed between the zeolite-free catalyst (catalyst of Example 1) and the catalysts containing it (catalysts of Examples 2 and 3). Also, a gain of about 78% is observed between the silica-alumina-based catalyst (catalyst Example 4) and the catalysts containing it (catalysts Examples 2 and 3).

With respect to a zeolite that has not been dealuminated like that of Example 2, the use of a dealuminated zeolite such as that used in Example 3 enables the selectivity to be clearly improved.

In a general manner, the selectivity varies substantially with the conversion. The selectivity is accordingly higher when the conversion is low.

Example 6

Evaluation of catalysts A, B, C and D in a hydrocracking test with recycle of the "residue" fraction The charge and the conditions of the test are identical with those of Example 5. The use of recycling of the 380° fraction at the entry to the reactor enables a total conversion of the charge to be obtained. In this case, the term "pass conversion", which represents the effective conversion realized at the level of the catalyst, is used.

The pass conversion PC is equal to:

$$PC = \frac{(\text{weight of } 380^- \text{ effluents})}{(\text{weight of } 380^- \text{ charge}) + (\text{weight of } 380^+ \text{ charge})} \times 100$$

The rough selectivity SB is equal to:

$$SB = \frac{(\text{weight of } 150/380 \text{ effluents})}{(\text{weight of } 380^- \text{ effluents})} \times 100$$

| Number of Example | Zeolite Content (Weight %) | Crystalline Parameter (× $10^{-10}$ meter) | T (°C.) (50% NC) | SB (50% NC) |
|---|---|---|---|---|
| 1 | 0 | / | 447 | 89.2 |
| 2 | 20 | 24.55 | 332 | 56.0 |
| 3 | 20 | 24.28 | 345 | 67.5 |

-continued $$SB = \frac{\text{(weight of 150/380 effluents)}}{\text{(weight of 380}^{-}\text{ effluents)}} \times 100$$

| Number of Example | Zeolite Content (Weight %) | Crystalline Parameter ($\times 10^{-10}$ meter) | T (°C.) (50% NC) | SB (50% NC) |
|---|---|---|---|---|
| 4 | 0 | / | 428 | 87.4 |

As in the case of Example 5, the use of a zeolite permits of reducing the temperature of iso-conversion substantially. The use of a de-aluminated zeolite such as that used in Example 3, by comparison with an un-de-aluminated zeolite like that of Example 2, enables the selectivity to be appreciably improved.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A method of hydrocracking a charge emanating from the Fisher-Tropsch process, said charge comprising unsaturated and oxygenated hydrocarbon molecules, said method comprising:

(a) reacting hydrogen with the charge in contact with a first catalyst in a first reaction zone, the first catalyst comprising at least one matrix consisting essentially of alumina and at least one first hydro-dehydrogenation component to remove unsaturated and oxygenated hydrocarbon molecules from the charge;

(b) contacting the resultant effluent from the first reaction zone with a second catalyst in a second reaction zone, the second catalyst comprising:

20 to 97% by weight of at least one matrix;

3 to 80% by weight of at least one Y zeolite in hydrogen form, said Y zeolite having a $SiO_2$:$Al_2O_3$ molar ratio of over 4.5:1, a sodium content of less than 1% by weight determined on a zeolite calcined at 1100° C., an $a_0$ crystal parameter of the elemental mesh of less than $24.70\times10^{-10}$ m; and a specific surface area determined by the BET method of over 400 $m^2.g^{-1}$;

and at least one second hydro-dehydrogenation component, to produce a hydrocracked product.

2. A method according to claim 1, in which the Y zeolite has a $SiO_2$:$Al_2O_3$ molar ratio of 8:1 to 70:1; a sodium content of less than 0.5% by weight determined on a zeolite calcined at 1100° C.; an $a_o$ crystal parameter of the elemental mesh of $24.24\times10^{-10}$ to $24.55\times10^{-10}$ m; and a specific surface area determined by the BET method of over 500 $m^2.g^{-1}$.

3. A method according to claim 1, in which the first and second hydro-dehydrogenation components are each independently a combination of at least one metal or metal compound from Group VIII and at least one metal or metal compound from Group VI of the Periodic Table of elements.

4. A method according to claim 3 in which, the second hydro-dehydrogenation component is used in stage (b) in an amount of 5 to 40% by weight relative to the total second catalyst, the weight ratio, expressed as metal oxides, of Group VIII to Group VI metals being from 0.05:1 to 0.8:1 and, first hydro-dehydrogenation component is used in stage (a) in an amount of 5 to 40% by weight relative to the total first catalyst, the weight ratio, expressed as metal oxides, of Group VIII to Group VI metals being from 1.25:1 to 20:1.

5. A method according to claim 1, in which the first and second hydro-dehydrogenation components are each independently at least one metal or metal compound from Group VIII of the Periodic Table.

6. A method according to claim 3, in which one or both of the hydro-dehydrogenation components further comprises phosphorus.

7. A method according to claim 6, in which the phosphorus content, expressed as the weight of phosphorus oxide $P_2O_5$ relative to the total first or second catalyst, is below 15%.

8. A method according to claim 1, in which at least part of the effluent from the second reaction zone is recycled to the entrance of one of the first or second reaction zone.

9. A method according to claim 8, in which recycling is to the entrance of the second reaction zone.

10. A method according to claim 2, in which the first and second hydro-dehydrogenation components are each independently a combination of at least one metal or metal compound from Group VIII and at least one metal or metal compound from Group VI of the Periodic Table of elements.

11. A method according to claim 10, in which one or both of the hydro-dehydrogenation components further comprises phosphorus.

12. A method according to claim 2, in which the first and second hydro-dehydrogenation components are each independently at least one metal or metal compound from Group VIII of the Periodic Table.

13. A method according to claim 12, in which one or both of the hydro-dehydrogenation components further comprises phosphorus.

14. A method according to claim 10 in which, the second hydro-dehydrogenation component is used in stage (b) in an amount of 5% to 40% by weight relative to the total second catalyst, the weight ratio, expressed as metal oxides, of Group VIII to Group VI metals being from 0.05:1 to 0.8:1 and, the first hydro-dehydrogenation component is used in stage (a) in an amount of 5% to 40% by weight relative to the total first catalyst, the weight ratio, expressed as metal oxides, of Group VIII to Group VI metals being from 1.25:1 to 20:1.

15. The method of claim 5, wherein the second hydro-dehydrogenation component is used in stage (b) is a noble Group VIII metal present in an amount of 0.01 to 5% by weight relative to the total weight of the second catalyst.

16. The method of claim 5, wherein the second hydro-dehydrogenation component used in stage (b) is a non-noble Group VIII metal present in an amount of 0.01 to 155 by weight relative to the total weight of the second catalyst.

17. The method of claim 12, wherein the second hydro-dehydrogenation component used in stage (b) is a noble Group VIII metal present in an amount of 0.01 to 5% by weight relative to the total weight of the second catalyst.

18. The method of claim 12, wherein the second hydro-dehydrogenation component used in stage (b) is a non-noble Group VIII metal present in an amount of 0.01 to 15% by weight relative to the total weight of the second catalyst.

* * * * *

UNITED STATES PATENT AND TRADEMARK OFFICE

CERTIFICATE OF CORRECTION

PATENT NO. : 5,345,019

DATED : September 6, 1994

INVENTOR(S) : Pierre-Henri BIGEARD et al.

It is certified that error appears in the above-indentified patent and that said Letters Patent is hereby corrected as shown below:

Claim 16, Column 10, Line 57: Delete " 155 " and insert -- 15% --.

Signed and Sealed this

Sixth Day of December, 1994

*Attest:*

*Attesting Officer*

BRUCE LEHMAN

*Commissioner of Patents and Trademarks*